US007201500B2

(12) United States Patent
Mishan

(10) Patent No.: US 7,201,500 B2
(45) Date of Patent: Apr. 10, 2007

(54) CANDLE WITH LED SIMULATED FLAME

(75) Inventor: Steven Mishan, New York, NY (US)

(73) Assignee: E. Mishan & Sons, Inc., New York, NY (US)

( * ) Notice: Subject to any disclaimer, the term of this patent is extended or adjusted under 35 U.S.C. 154(b) by 151 days.

(21) Appl. No.: 11/181,259

(22) Filed: Jul. 14, 2005

(65) Prior Publication Data

US 2007/0014107 A1 Jan. 18, 2007

(51) Int. Cl.
*F21V 21/00* (2006.01)

(52) U.S. Cl. ..... 362/392; 362/569; 362/810

(58) Field of Classification Search ..... 362/810, 362/161, 392, 190, 157, 159, 565–569, 121–124, 362/447, 582, 583, 807, 808; 431/253, 125, 431/126, 289, 291; 428/7
See application file for complete search history.

(56) References Cited

U.S. PATENT DOCUMENTS

| | | | |
|---|---|---|---|
| 3,890,085 | A | 6/1975 | Andeweg et al. |
| 4,617,614 | A | 10/1986 | Lederer |
| 5,152,602 | A | 10/1992 | Boschetto |
| 5,791,774 | A | 8/1998 | Briles |
| 5,980,064 | A | 11/1999 | Metroyanis |
| 6,017,139 | A | 1/2000 | Lederer |
| 6,241,362 | B1 | 6/2001 | Morrison |
| 6,520,770 | B2 | 2/2003 | Zou |
| 6,595,676 | B2 | 7/2003 | Starry |
| 6,616,308 | B2 | 9/2003 | Jensen et al. |
| 6,685,345 | B1 | 2/2004 | Velasquez |
| 6,688,752 | B2 | 2/2004 | Moore |
| 6,719,443 | B2 | 4/2004 | Gutstein et al. |
| 6,729,748 | B2 | 5/2004 | Reilly et al. |
| 6,808,297 | B2 | 10/2004 | Jensen et al. |

FOREIGN PATENT DOCUMENTS

| | | |
|---|---|---|
| WO | WO 2004/083718 | 9/2004 |

*Primary Examiner*—Renee Luebke
*Assistant Examiner*—Robert May
(74) *Attorney, Agent, or Firm*—Notaro & Michalos PC

(57) ABSTRACT

A candle has a wax or wax-simulating body with a top wall, a simulated burnt wick, a cylindrical side wall, and an interior candle cavity. A partly transparent housing with top and side walls together defining a housing cavity, is located in the candle cavity. An annular, transparent flange extends upwardly to a lower surface of the top wall of the body. An illumination assembly connected to the housing, extends into the housing cavity and includes an LED, a circuit for powering the LED and a battery compartment or other power source for powering the circuit. The lamp is spaced from the top wall of the housing and positioned for casting light through the top wall of the housing, into a light directing space defined by the flange, and to the top wall of the candle body.

20 Claims, 5 Drawing Sheets

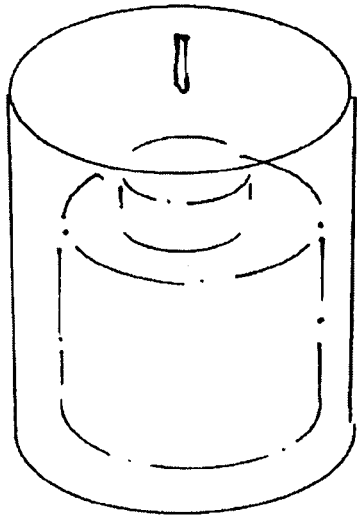
FIG. 4
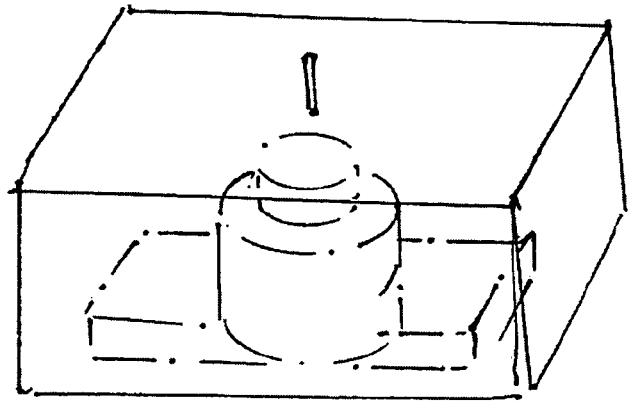
FIG. 5
FIG. 6
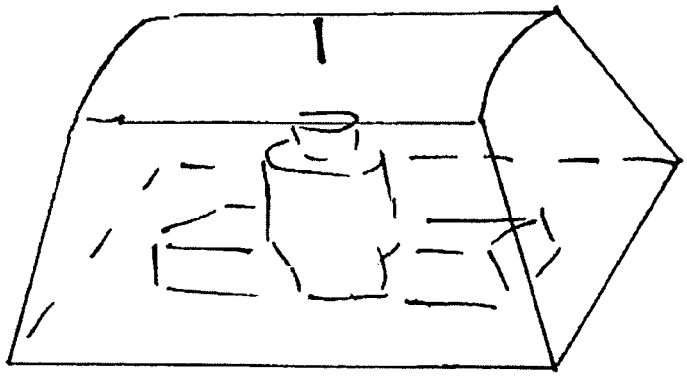

CANDLE WITH LED SIMULATED FLAME

FIELD AND BACKGROUND OF THE INVENTION

The present invention relates generally to the field of decorative candles, and in particular to a new and useful candle that lights with a realistic but electrically powered orange-yellow simulated flame and which does not use fire.

Published PCT Application WO 2004/083718 to Perleberg discloses a burning candle with an LED. The candle includes a wax body with a wick and a hollow space. A downwardly open shell is set inside the hollow space and an illumination unit is mounted in the shell. The illumination unit contains an electrical luminous means disposed on a circuit board which is directly attached to a 9V battery. The 9V battery is clamped in a transparent rubber ring which comprises outwardly extending projections that are in contact with the inner wall of the open shell. The illumination unit is accessible for replacement.

Other relevant prior art can be found in U.S. patent classes/subclasses: 313/116; 362/161, 190, 311, 351, 392, 806, 810; and 431/125, 253, 288, 289, 291.

The following references are of particular interest to the present invention:

| U.S. Pat. No. | Inventor(s) |
|---|---|
| 3,890,085 | Andeweg |
| 4,617,614 | Lederer |
| 5,152,602 | Boschetto |
| 5,791,774 | Briles |
| 5,980,064 | Metroyanis |
| 6,017,139 | Lederer |
| 6,241,362 | Morrison |
| 6,520,770 | Zou |
| 6,595,676 | Starry |
| 6,616,308 | Jensen et al. |
| 6,685,345 | Velasquez |
| 6,719,443 | Gutstein et al. |
| 6,729,748 | Reilly |
| 6,808,297 | Jensen et al. |

U.S. Pat. No. 6,616,308 to Jenesen et al. discloses an ornamental illumination apparatus comprising a light diffusing body, a cavity within the light diffusing body, and a small high intensity light source disposed within the cavity near the top of the body.

U.S. Pat. No. 6,241,362 to Morrison discloses a lighted display device for illuminating a translucent display article placed on the display device. The lighted display device includes a base for removable placement upon a level surface.

U.S. Pat. No. 6,729,748 to Reilly discloses a decorative electrical lighting device comprising a body formed of candle wax having a top portion, a bottom portion, and a longitudinal channel formed therein between the top end portion said bottom portion. The longitudinal channel opens into a widened opening at the top portion of said body and means are provided for supporting an electrical light fixture within the widened opening of said longitudinal channel.

U.S. Pat. No. 6,520,770 to Zou discloses a candle device that includes a transparent outer tubular body having a chamber inside, an open end defining a supporting rim, and a base. A transparent inner tubular member is mounted within the outer tubular body. A lighting element having a light emitting portion is disposed in a chamber of the inner tubular member, which lights up the outer tubular body. A cover, which is disposed on the supporting rim of the tubular body, has a through hole. The light emitting portion of the lighting element penetrates through the hole and outside of the candle device. The base houses sound means, light means, and power supply means for the sound means and light means.

U.S. Pat. No. 5,791,774 to Briles discloses an outdoor illumination device of the type used for holiday decoration by aligning a plurality of such illumination devices in a linear array. The illumination device comprises a body with walls forming a cavity. A base is formed at one end of the body and an access opening is formed at an opposite end of the body. The body is configured for emission of at least some light when illumination occurs within the cavity. The base includes means for supporting a candle and means for supporting an electric lamp socket. The means for supporting a candle and the means for supporting an electric lamp socket are juxtaposed and configured for non-simultaneous accommodation of a candle and an electric lamp.

The remaining patents disclose other candles or decorative devices which are distinguishable from the present invention. For example, U.S. Pat. No. 3,890,085 to Andeweg discloses a light source attached to a battery in the bottom of a candle. However, light scatters only to the sides and is not focused toward the top. U.S. Published Patent Application US 2003/0035291 to Jensen discloses an illumination unit containing an LED near the top of the candle, a circuit board, and batteries arranged in a lower cavity of an imitation candle body.

The use of candles with real flames is dangerous both due to the risk of fire and also because of the generation of soot and fumes. Most burning candles are made from paraffin wax, a petroleum by-product. Burning of paraffin wax releases soot and other toxins, some of which are known to be carcinogenic, such as benzene. Candle light has always been desirable, however for a variety of reasons. A need remains for an improved candle with a simulated flame and the present invention satisfies that need.

SUMMARY OF THE INVENTION

It is an object of the present invention to provide an improved candle which simulates a flame on a wick but which uses an electrically powered lamp to cast light that looks like a flame but which does not use fire and is therefore safer than conventional burning candles.

The candle body is hollow and contains a plastic shell or housing that is partly covered with a translucent material such as the same wax or wax-simulating material of the candle body. A lighting arrangement or illumination assembly is mounted inside the plastic shell. The lighting arrangement includes a circuit board, a light source and a power source. The light source is preferably an LED and the power source is preferably a pair of batteries of the elongated type such as AA or AAA batteries. The LED is connected to the circuit board, which in turn, is connected to the batteries by contacts in the battery compartment. A switch is connected to the circuit board for turning the LED on. The LED is a bright yellow or orange-yellow color for simulating a flame and the circuit board includes a circuit of known design for causing the light from the LED to flicker, again to simulate a flame.

When the plastic shell is placed inside the candle body of the imitation candle, the lighting arrangement is positioned at the bottom of the imitation candle. When the light source is turned on, the light scatters in all directions so that the imitation candle is uniformly lit on all sides, but also is directed or concentrated to the top wall of the candle body around the wick to simulate flame at the top of the candle.

Accordingly, a further object of the invention is to provide a candle with a candle body of a wax or wax-simulating material like ETPA (ester-terminated poly amine), with a top wall with a simulated burnt wick, a preferably, but not exclusively cylindrical side wall, and an interior candle cavity. A transparent housing with top and side walls together defining a housing cavity, is in the candle cavity. An annular, transparent flange extends upwardly to a lower surface of the top wall of the body. An illumination assembly connected to the housing, extends into the housing cavity and includes a lamp like an LED, a circuit for powering the LED and a battery compartment or other power source for powering the circuit. The lamp is spaced from the top wall of the housing and positioned for casting light through the top wall of the housing, into a light directing space defined by the flange, and to the top wall of the candle body.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 4 is a top, side perspective view of the candle of FIG. 1;

FIG. 5 is a top, side perspective view of a further candle of the present invention that may use the illumination assembly of FIGS. 2 or 3;

FIG. 6 is a top, side perspective view of another candle of the present invention that may use the illumination assembly of FIGS. 2 or 3.

DESCRIPTION OF THE PREFERRED EMBODIMENTS

Figure 1:
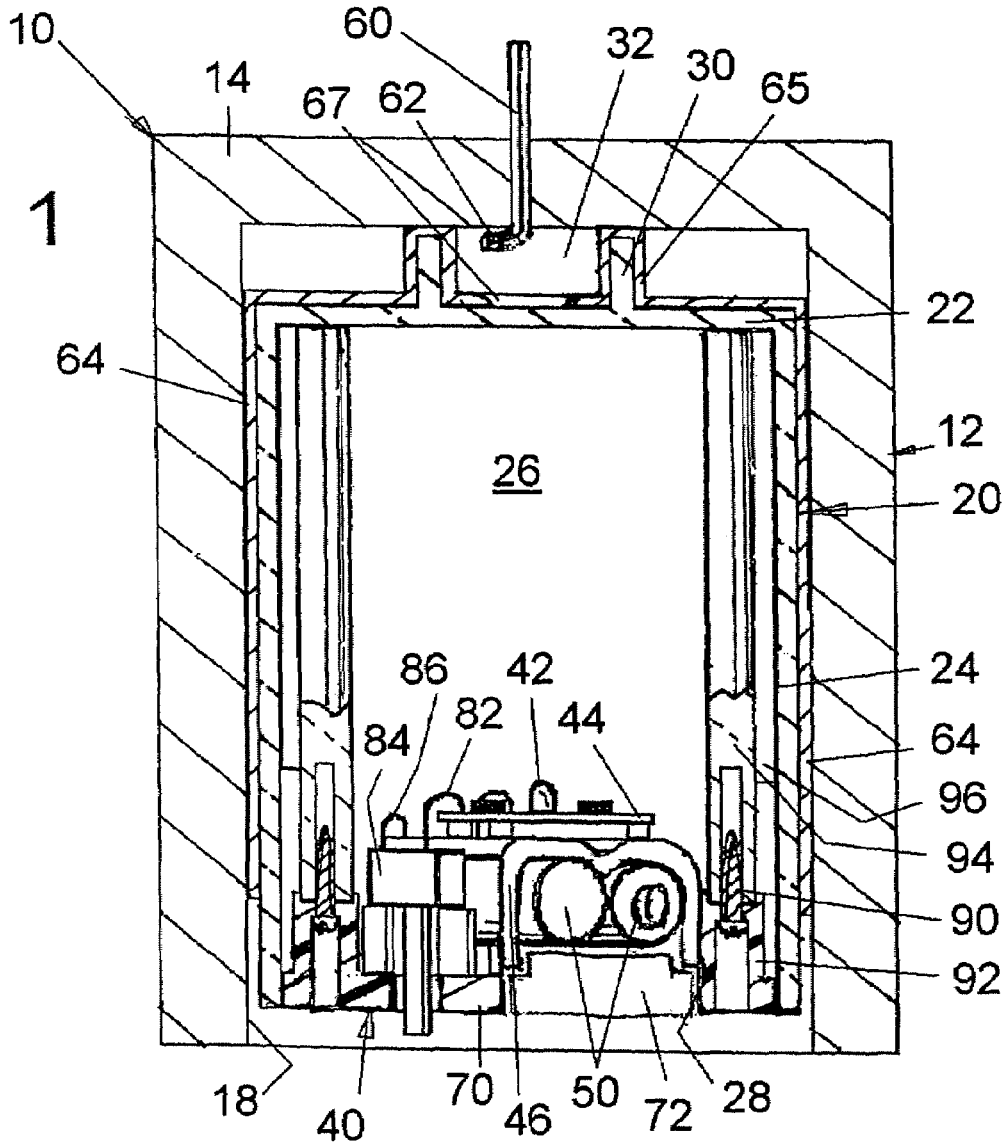
FIG. 1 is a side sectional view of a candle with electric simulated flame according to a first embodiment of the present invention.

Referring now to the drawings, in which like reference numerals are used to refer to the same or similar elements, FIG. 1 shows a candle 10 for generating a simulated flame, comprising a candle body 12 having a top wall 14 with upper and lower surfaces, at least one, e.g. cylindrical side wall 16 made as one piece with the top wall 14, and a bottom opening 18. The candle body 12 defines an interior candle cavity 26 which is cylindrical in the embodiment of FIG. 1, and which communicates with the bottom opening 18 and is bounded at the top by the lower surface of the top wall 14.

The candle body is made of candle wax or a wax-simulating material. ETPA or ester-terminated poly amide mixed with mineral oil is a known wax-simulating material, for example. Since the material does not burn, it is only important that the material look like wax so that those skilled in the art can select an appropriate material for the candle body. Like wax, the material must be translucent, that is, capable of passing light but not images.

The candle includes a housing 20 having a top wall 22 and at least one side wall 24 together defining a housing cavity inside candle cavity 26, the housing cavity having a bottom opening 28.

At least part of the top wall 22, but preferably the entire housing 20 is made of transparent plastic material such as polycarbonate or any other transparent plastic of suitable strength. The housing is positioned inside the candle cavity 26 with the bottom openings of the candle body and housing, 18 and 28 respectively, being near each other and the top wall 22 being spaced below and facing the lower surface of the top wall 14 of the candle body.

An annular and transparent flange 30 is formed as one piece with the top wall 22 of the housing 20 and extends upwardly of the top wall substantially to the lower surface of the top wall 14 of the candle body 12. The flange defines an upwardly open light directing space 32 for directing light to the top wall of the candle body.

Figure 2:
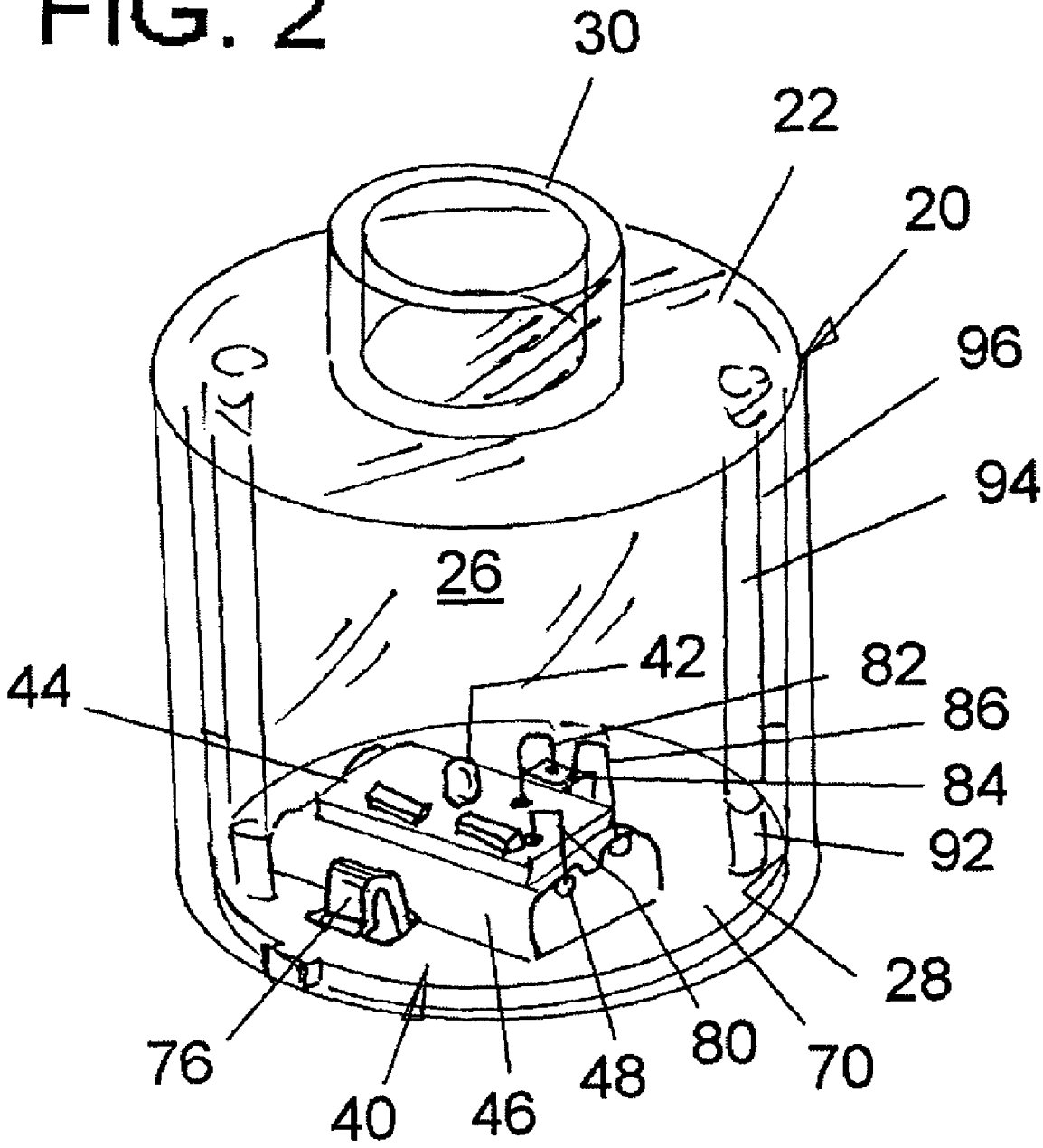
FIG. 2 is a top, side perspective view of the illumination assembly of the candle of FIG. 1.

An illumination assembly 40 is connected to the side wall 24 of the housing 20 for closing the bottom opening 28. The assembly extends into the housing cavity and includes an electric light emitting lamp 42 on a circuit board 44 that also carries a circuit for powering the lamp, and power means for supplying electrical power to the circuit, such as a battery compartment 46 with contacts 48 (see FIGS. 2 and 7) for electrically connecting one or more batteries 50 to the circuit.

The lamp is spaced from the top wall of the housing and positioned for casting light toward and through the top wall of the housing, into the light directing space 32 and to the top wall of the candle body, for a cylindrical candle cavity 26, by at least the diameter of the cavity.

A simulated burnt wick 60 extends upwardly through and from the top wall 14 of the candle body and is substantially centered with respect to the light directing space 32. Wick 60 is preferably made of black rubber tubing that is bent or crimped at 62, under the lower surface of top wall 14, to resist being pulled out of the top wall.

A layer 64 of the wax or wax-simulating material at least partly covers the housing and engages the candle body in the candle cavity 26 for adhering the outer surface of the housing 20 to the inner surface of the candle body 12.

The layer of wax or wax-simulating material may also extend at 65, to inner and/or outer surfaces of the flange 30, and the top rim of the flange 30 to contact the lower surface of top wall 14 of the candle body, for defusing light from the lamp 42 to the space 32 and to and through the top wall 14 of the candle body. The wax layer may also cover the top of housing top wall 22 inside space 32, or leave a hole 67 in this layer 65, centered under the base of wick 60 to allow more focused and thus brighter light to shine under wick 60 to simulate a flame.

With the housing, its housing cavity and the candle cavity being substantially cylindrical, an outer diameter of the housing is smaller than an inner diameter of the candle cavity to define an annular space therebetween, and the layer of wax or wax-simulating material at least partly fills this annular space for bonding the housing to the candle body in a very secure fashion so that the housing cannot easily be removed from the candle body cavity during normal use of the candle, or the housing does not fall out of the body if the candle is lifted from a support surface.

The illumination assembly 40 includes a circular bottom platform 70 defining the battery 46 compartment, the battery compartment being shaped for receiving at least one horizontally elongated battery such as two M or AAA batteries 50. This provides adequate power for sufficient time to make the candle practical in use, while maintaining a low profile for the assembly, to keep the LED 42 spaced sufficiently from the lower surface of top wall 14 to effectively disperse the light from the LED evenly around the interior of cavity 26 and out the top and side walls of the candle body. The flange 30, coated with the wax layer 65, however, concentrates some extra light into the space 32 to better simulate a flame at wick 60.

The electrical contacts 48 at the battery compartment electrically connect the batteries in the battery compartment to the circuit on board 44 for powering the lamp. Other power supply means may be used, however, such as a 3 volt adapter for plugging the candle into a wall outlet.

Figure 7:
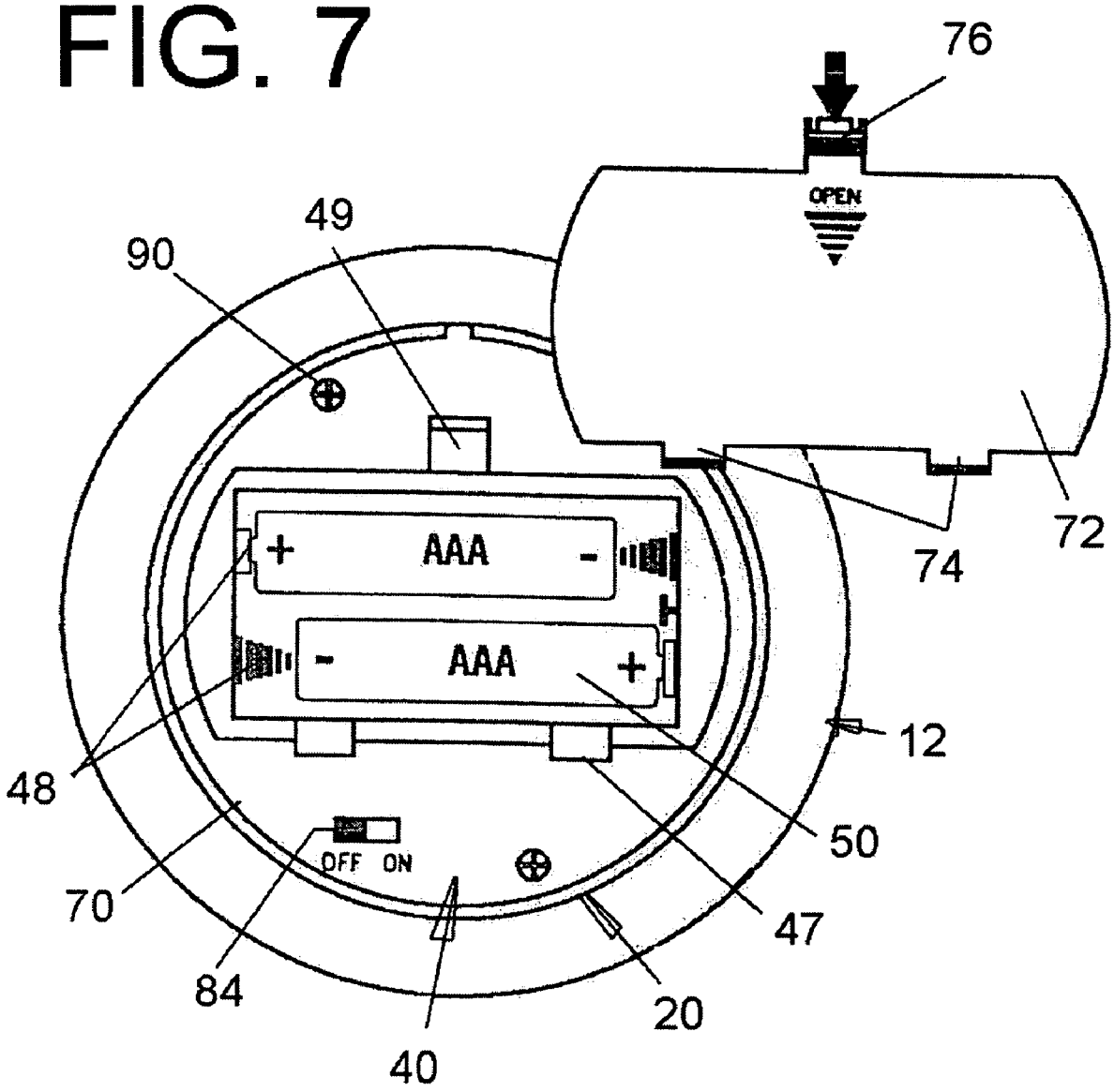
FIG. 7 is an exploded, bottom view of the candle of FIG. 1 with the battery door removed to show the batteries in the battery compartment for this embodiment of the invention.

The bottom platform 70 includes a removable door 72 shown also in FIG. 7, for closing a lower open end of the battery compartment 46. The assembly of the circuit board 44 and lamp 42 is mounted over the battery compartment so that the lamp disperses light into the candle cavity.

As shown in FIG. 7, the battery compartment door 70 includes a pair of hinges 74 that engage into slots 47 on one side of the compartment opening, and a U-shaped latch 76 (also visible in FIG. 2) for removably latching to a latch slot 49 on the other side of the compartment opening, for detachably closing the door over the compartment opening. Pressing the latch 76 in the direction of the arrow in FIG. 7 releases the door for installing and changing batteries 50.

The circuit on board 44 is connected by a wire 80 to one battery contact 48, and by a wire 82 to one pole of a switch 84. A wire 86 connects the other pole of switch 84 to another battery contact for completing the connection and allowing the lamp 42 to be lighted and extinguished using the switch 84.

As shown in FIGS. 1 and 7, the circular platform 70 of assembly 40 can be connected to the housing side wall 24 by screws 90 that extend through cylindrical projections 92 cast as one piece with the platform, and into blind bores at the base of a pair of cylindrical projections 94, attached to the inner surface of side wall 24 by vertically extending plates 96, all cast as one piece with the housing 20.

Figure 3:
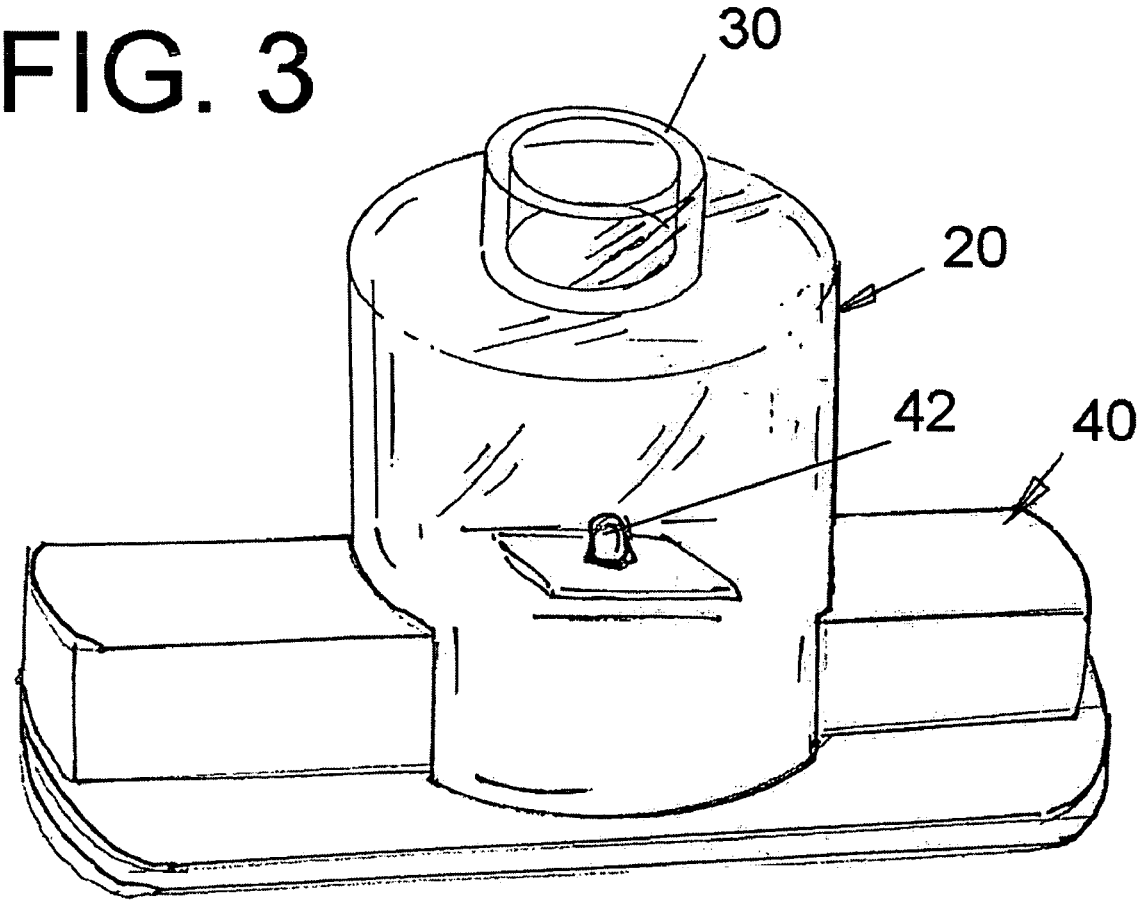
FIG. 3 is a top, side perspective view of the illumination assembly of a second embodiment of the present invention.

FIG. 3 shows another embodiment of the invention where the platform of the base of the illumination assembly 40 is elongated under housing 20 for insertion into an elongated candle body, such as a candle body that is rectangular as shown in FIG. 5, or echelon shaped as shown in FIG. 6.

For rectangular or echelon shaped candle bodies, the candle cavity is still cylindrical to closely encompass the cylindrical housing 20 and be adhered to it by the wax layer 64. Some additional wax or wax-like material at the base of the elongated candle body is also removed, however, to accommodate the elongated base of assembly 40.

While specific embodiments of the invention have been shown and described in detail to illustrate the application of the principles of the invention, it will be understood that the invention may be embodied otherwise without departing from such principles.

What is claimed is:

1. A candle for generating a simulated flame, comprising:

a candle body having a top wall with upper and lower surfaces, at least one side wall made as one piece with the top wall, and a bottom opening, the candle body defining an interior candle cavity communicating with the bottom opening and bounded at the top by the lower surface of the top wall, the candle body being made of material selected from the group consisting of wax and wax-simulating material;

a housing having a top wall and at least one side wall together defining a housing cavity having a bottom opening, at least part of the top wall being transparent, the housing being positioned inside the candle cavity with the bottom openings of the candle body and housing being near each other, the housing top wall being spaced below and facing the lower surface of the top wall of the candle body;

an annular and transparent flange formed as one piece with the top wall of the housing and extending upwardly of the top wall substantially to the lower surface of the top wall of the candle body, the flange defining an upwardly open light directing space for directing light to the top wall of the candle body; and an illumination assembly connected to the side wall of the housing for closing the bottom opening of the housing and extending into the housing cavity, the illumination assembly including an electric light emitting lamp, a circuit for powering the lamp and power means for supplying electrical power to the circuit, the lamp being spaced from the top wall of the housing and positioned for casting light toward and through the top wall of the housing, into the light directing space, and to the top wall of the candle body.

2. A candle according to claim 1, including a simulated burnt wick extending upwardly from the top wall of the candle body and substantially centered with respect to the light directing space.

3. A candle according to claim 1, including a layer of at least one of wax and wax-simulating material at least partly covering the housing and engaged with the candle body in the candle cavity for adhering the housing to the candle body.

4. A candle according to claim 1, including a layer of at least one of wax and wax-simulating material on at least one of inner and outer surfaces of the flange for defusing light from the lamp to the top wall of the candle body.

5. A candle according to claim 1, including a layer of at least one of wax and wax-simulating material at least partly covering the housing and engaged with the candle body in the candle cavity for adhering the housing to the candle body, the layer also covering one at least one of inner and outer surfaces of the flange for defusing light from the lamp to the top wall of the candle body.

6. A candle according to claim 1, wherein the housing, the housing cavity and the candle cavity are substantially cylindrical with an outer diameter of the housing being smaller than an inner diameter of the candle cavity to define an annular space there between, and a layer of wax or wax-simulating material at least part filling the annular space for bonding the housing to the candle body.

7. A candle according to claim 1, wherein the illumination assembly includes a bottom platform defining a battery compartment for forming at least part of the power means, the battery compartment being shaped for receiving at least one horizontally elongated battery, the power means including electrical contacts in the battery compartment for electrically connecting a battery in the battery compartment to the circuit for powering the lamp.

8. A candle according to claim 1, wherein the illumination assembly includes a bottom platform defining a battery compartment for forming at least part of the power means, a removable door for closing a lower open end of the battery compartment, the battery compartment being shaped for receiving at least one horizontally elongated battery, the power means including electrical contacts in the battery compartment for electrically connecting a battery in the battery compartment to the circuit for powering the lamp, the circuit comprising a circuit board carrying the lamp and being mounted over the battery compartment, the lamp comprising an LED which is spaced from the lower surface of the top wall of the candle body by at least a horizontal diameter of the housing for dispersing light into the candle cavity.

9. A candle according to claim 1, including a layer of at least one of wax and wax-simulating material on at least one of inner and outer surfaces of the flange for defusing light from the lamp to the top wall of the candle body.

10. A candle according to claim 1, including a layer of at least one of wax and wax-simulating material at least partly covering the housing and engaged with the candle body in the candle cavity for adhering the housing to the candle body, the layer also covering at least one of inner and outer surfaces of the flange for defusing light from the lamp to the top wall of the candle body, the housing being substantially cylindrical and the illumination assembly including a bottom platform defining a battery compartment for forming at least part of the power means, a removable door for closing a lower open end of the battery compartment, the battery compartment being shaped for receiving at least one horizontally elongated battery, the power means including electrical contacts in the battery compartment for electrically connecting a battery in the battery compartment to the circuit for powering the lamp, the circuit comprising a circuit board carrying the lamp and being mounted over the battery compartment, the lamp comprising an LED which is spaced from the lower surface of the top wall of the candle body by at least a horizontal diameter of the housing for dispersing light into the candle cavity.

11. A candle according to claim 1, wherein the candle body is cylindrical.

12. A candle according to claim 1, wherein the candle body is rectangular.

13. A candle according to claim 1, wherein the candle body is echelon shaped.

14. A candle according to claim 1, wherein the illumination assembly includes a bottom platform defining a battery compartment for forming at least part of the power means, the platform being horizontally elongated and the candle body being horizontally elongated.

15. A candle for generating a simulated flame, comprising:

a candle body having a top wall with upper and lower surfaces, at least one side wall made as one piece with the top wall, and a bottom opening, the candle body defining an interior candle cavity communicating with the bottom opening and bounded at the top by the lower surface of the top wall, the candle body being made of material selected from the group consisting of wax and wax-simulating material;

a housing having a top wall and at least one side wall together defining a housing cavity having a bottom opening, at least part of the top wall being transparent, the housing being positioned inside the candle cavity with the bottom openings of the candle body and housing being near each other, the housing top wall being spaced below and facing the lower surface of the top wall of the candle body;

an annular and transparent flange formed as one piece with the top wall of the housing and extending upwardly of the housing top wall substantially to the lower surface of the top wall of the candle body, the flange defining an upwardly open light directing space for directing light to the top wall of the candle body;

an illumination assembly connected to the side wall of the housing for closing the bottom opening of the housing and extending into the housing cavity, the illumination assembly including an electric light emitting lamp, a circuit for powering the lamp and power means for supplying electrical power to the circuit, the lamp being spaced from the top wall of the housing and positioned for casting light toward and through the top wall of the housing, into the light directing space and to the top wall of the candle body;

a simulated burnt wick extending upwardly from the top wall of the candle body and substantially centered with respect to the light directing space;

a layer of at least one of wax and wax-simulating material at least partly covering the housing and engaged with the candle body in the candle cavity for adhering the housing to the candle body, the layer also being on at least one of inner and outer surfaces of the flange for defusing light from the lamp to the top wall of the candle body;

the housing and housing cavity being substantially cylindrical, wherein an outer diameter of the housing is smaller than an inner diameter of the candle cavity to define an annular space therebetween, and a layer of wax or wax-simulating material at least partly fills the annular space for bonding the housing to the candle body;

the illumination assembly including a bottom platform defining a battery compartment for forming at least part of the power means, and a removable door for closing a lower open end of the battery compartment, the battery compartment being shaped for receiving at least one horizontally elongated battery, the power means including electrical contacts in the battery compartment for electrically connecting a battery in the battery compartment to the circuit for powering the lamp; the circuit comprising a circuit board carrying the lamp and being mounted over the battery compartment; and the lamp comprising an LED which is spaced from the lower surface of the top wall of the candle body be at least a horizontal diameter of the housing for dispersing light into the candle cavity.

16. A candle according to claim 15, wherein the candle body is cylindrical.

17. A candle according to claim 15, wherein the candle body is rectangular.

18. A candle according to claim 15, wherein the candle body is echelon shaped.

19. A candle according to claim 15, wherein the platform is horizontally elongated and the candle body is horizontally elongated.

20. A candle according to claim 15, wherein the platform is horizontally elongated and the candle body is one of a horizontally elongated rectangle or echelon shape.

* * * * *